US005353877A

United States Patent [19]

DeCorps et al.

[11] Patent Number: 5,353,877

[45] Date of Patent: Oct. 11, 1994

[54] ELECTRICALLY CONTROLLED LATCH FOR WELL APPLICATIONS

[75] Inventors: Jean-Luc DeCorps, Anthony; Ting Lau, Fontainebleau, both of France

[73] Assignee: Schlumberger Technology Corporation, Houston, Tex.

[21] Appl. No.: 26,344

[22] Filed: Mar. 4, 1993

[30] Foreign Application Priority Data

Mar. 5, 1992 [FR] France ..... 92 02642

[51] Int. Cl.[5] ..... E21B 23/04; E21B 31/20

[52] U.S. Cl. ..... 166/385; 166/65.1; 166/66.4; 166/373

[58] Field of Search ..... 166/385, 65.1, 66.4, 166/72, 373; 403/31, 322, 325, 315

[56] References Cited

U.S. PATENT DOCUMENTS 3,661,205 5/1972 Berlorgey ..... 166/104 X
4,790,380 12/1988 Ireland et al. ..... 166/250
4,896,721 1/1990 Welch ..... 166/214
5,024,277 6/1991 Ricles ..... 166/381

*Primary Examiner*—Stephen J. Novosad
*Attorney, Agent, or Firm*—Henry N. Garrana; John H. Bouchard

[57] ABSTRACT

A wireline assembly suspended from a cable is lowered down an oil well for temporary latching to a downhole assembly. Latching is provided by keys mounted in the wireline assembly to engage in a complementary recess formed in the downhole assembly and cooperating therewith via surfaces that are perpendicular to the longitudinal axis of the device. Unlocking is obtained by pulling on the cable after an electrically controlled valve has been excited. The valve then communicates two chambers delimited by a control piston inside a cylinder formed in a tubular housing supporting the keys. The tension exerted on the cable is transmitted to the control piston by a rod which actuates an unlocking collar that causes the keys to be retracted.

19 Claims, 3 Drawing Sheets

ELECTRICALLY CONTROLLED LATCH FOR WELL APPLICATIONS

The invention relates to a method for unlatching a wireline assembly from a downhole assembly located in an oil well. The invention also relates to a method for latching and unlatching in succession a wireline assembly. Finally, the invention relates to a device for implementing these methods.

In order to work an oil well satisfactorily, it is necessary to have accurate knowledge of characteristics of the well such as temperature and pressure, and also to monitor the variation of these characteristics over time.

To gain such knowledge, it is the practice to provide a downhole assembly at the bottom portion of the production tubing in an oil well, which assembly includes, in particular, means for measuring and recording pressure and temperature data.

When it is desired to collect the information recorded in said downhole assembly, an assembly is lowered down the borehole suspended from an electrically conductive cable. This assembly, referred to hereinafter as the wireline assembly, is designed to latch to the downhole assembly and to enable the information recorded therein to be transferred to the surface via the electrically conductive cable.

Inductive coupling means are used to transmit the data recorded in the downhole assembly, the coupling means comprising coils belonging respectively to the downhole assembly and to the wireline assembly. Proper transmission of information via such a system assumes that the wireline assembly is positioned as accurately as possible inside the downhole assembly.

Such positioning is provided by the latching device that enables the wireline assembly to be mechanically secured to the downhole assembly. The latching device normally comprises retractable projecting members on the wireline assembly and commonly called "keys" or "dogs", which are mounted on the wireline assembly so as to be capable of moving radially and which are normally maintained in a projecting position by resilient means. When the wireline assembly is placed inside the downhole assembly, the keys penetrate into complementary recesses formed in the downhole assembly.

In existing latching devices, the keys are locked and unlocked relative to the recesses by means that are completely mechanical and that are received inside the wireline assembly, with remote control thereof being provided by exerting tension and release movements on the cable in a pre-established cycle.

More precisely, the keys are mounted on a tubular housing and urged radially outwards by cantilevered springs. A rod secured to the bottom end of the cable penetrates inside the tubular housing and is provided with limited axial clearance determined by co-operation between a stud carried by a ring rotatably mounted in the tubular housing and a slot formed in the outside surface of the rod.

In a first axial position of the rod inside the tubular housing, the keys face a smaller-diameter portion of the rod enabling the keys to be retracted into the housing. This first position corresponds to the latching device being unlocked.

In contrast, in a second axial position of the rod inside the tubular housing, a larger diameter portion of the rod faces the keys and prevents them from being retracted into the housing. This position corresponds to the latching device being locked.

When the wireline assembly is lowered down the well, the relative position between the stud and the slot is normally such that the latching device is unlocked. The keys carried by the tubular housing can thus retract when the wireline assembly penetrates into the downhole assembly, and return to their projecting position as soon as they come level with the complementary recesses formed therein. Given that the tubular housing is held stationary, further lowering of the rod causes the ring carrying the stud to rotate due to the stud co-operating with the slot formed in the rod. When a tension is subsequently exerted on the cable, the rod is raised inside the tubular housing, thereby further rotating the ring carrying the stud and bringing the stud into an elongate axial portion of the slot formed in the rod. The larger diameter portion which is at the bottom end of the rod then comes level with the keys and thus locks them in place.

When the latching device is to be unlocked, it is necessary to slacken the cable so as to cause the rod to move down again inside the tubular housing, thereby further rotating the ring carrying the stud. The shape of the slot formed on the rod is such that further tension exerted on the cable enables the latching device to be returned to its initial position during the lowering of the wireline assembly i.e. the position that corresponds to the latching device being unlocked. Because of co-operation between sloping surfaces formed on the keys and on the recesses, continued tension exerted on the cable then has the effect of causing the keys to be retracted and releasing the wireline assembly.

Entirely mechanical devices of this type suffer from drawbacks.

As shown by the above description, latching and unlatching are performed by successively exerting pulling and slackening movements on the cable. To ensure that the mechanism operates properly, it is necessary that gravity forces acting on the central rod when the cable is slackened cause said rod to move down inside the tubular housing. This is true only if the well in which the wireline device is located is vertical or nearly vertical. When the deviation of the well becomes significant (more than about 25°), then this downwards movement of the central rod can no longer be ensured. The greater the deviation of the portion of the well in which the latching device is to be found, i.e. the closer the well is to the horizontal, the greater this effect.

Another drawback of existing fully-mechanical latching devices is that users on the surface have no reliable information on the operating state of the latching device, as whether the device is locked or unlocked depends on the tension/release cycle to which the cable has previously been subjected.

In addition, the description above of existing mechanical latching devices shows that such devices can be unlocked only because the contact surfaces between the keys and the recesses are inclined surfaces which enable the keys to be retracted when a tension exceeding a certain threshold is exerted on the cable. The latching obtained by co-operation between the keys and the recesses is therefore not sufficient on its own, which explains that the locked state of the device is achieved only when retraction of the keys into the housing is prevented by the engagement of a larger diameter portion of the central rod level with the keys.

In practice, this feature has the consequence that it can be impossible to unlock the latching device if it turns out not to be possible from the surface to cause the rod to move down under gravity so as to shift its larger diameter portion downwards away from the keys. Such an accident can cause the cable to be broken and requires particularly complex and difficult maneuvers to be performed in order to recover the wireline assembly stuck at the bottom of the well.

For the same reasons, it can happen that the wireline assembly becomes stuck at the joint between two sections of tubing, with the keys becoming engaged in a larger diameter region of the tubing corresponding to said joint and being locked in said position by the larger diameter portion of the central rod. Although maneuvers analogous to those that are used normally to unlock the device can usually be performed so as to extract the wireline assembly, the assembly can nevertheless become completely jammed if the particular conditions prevent any downwards displacement of the central rod.

An object of the invention is to make it possible to control unlatching without using the force of gravity and thereby to use such a device in a well of any deviation, including in a portion that is substantially horizontal.

Another object of the invention is to enable users situated on the surface to be kept aware at all times of the locked or unlocked state of the device.

There is provided according to an aspect of the invention a method of unlatching from a downhole assembly placed in an oil well a wireline assembly suspended from a cable, comprising the steps of:

transmitting an unlatching authorization signal from the surface to the wireline assembly via the cable; and unlatching the wireline assembly by applying a tension to the cable.

According to another aspect, the invention provides a method of latching and unlatching a wireline assembly suspended from a cable relative to a downhole assembly placed in an oil well, comprising the steps of:

performing said latching automatically by co-operation between complementary abutment surfaces extending perpendicularly to a longitudinal axis common to said assemblies and formed respectively on retractable keys of the wireline assembly and in a complementary recess of the downhole assembly; and performing said unlatching by transmitting an unlatching authorization signal from the surface to the wireline assembly via the cable, and exerting a tension on the cable so as to cause the keys to be retracted, thereby disengaging the complementary abutment surfaces.

A preferred embodiment of the invention is described below by way of non-limiting example and with reference to the accompanying drawings, in which.

Figure 1:
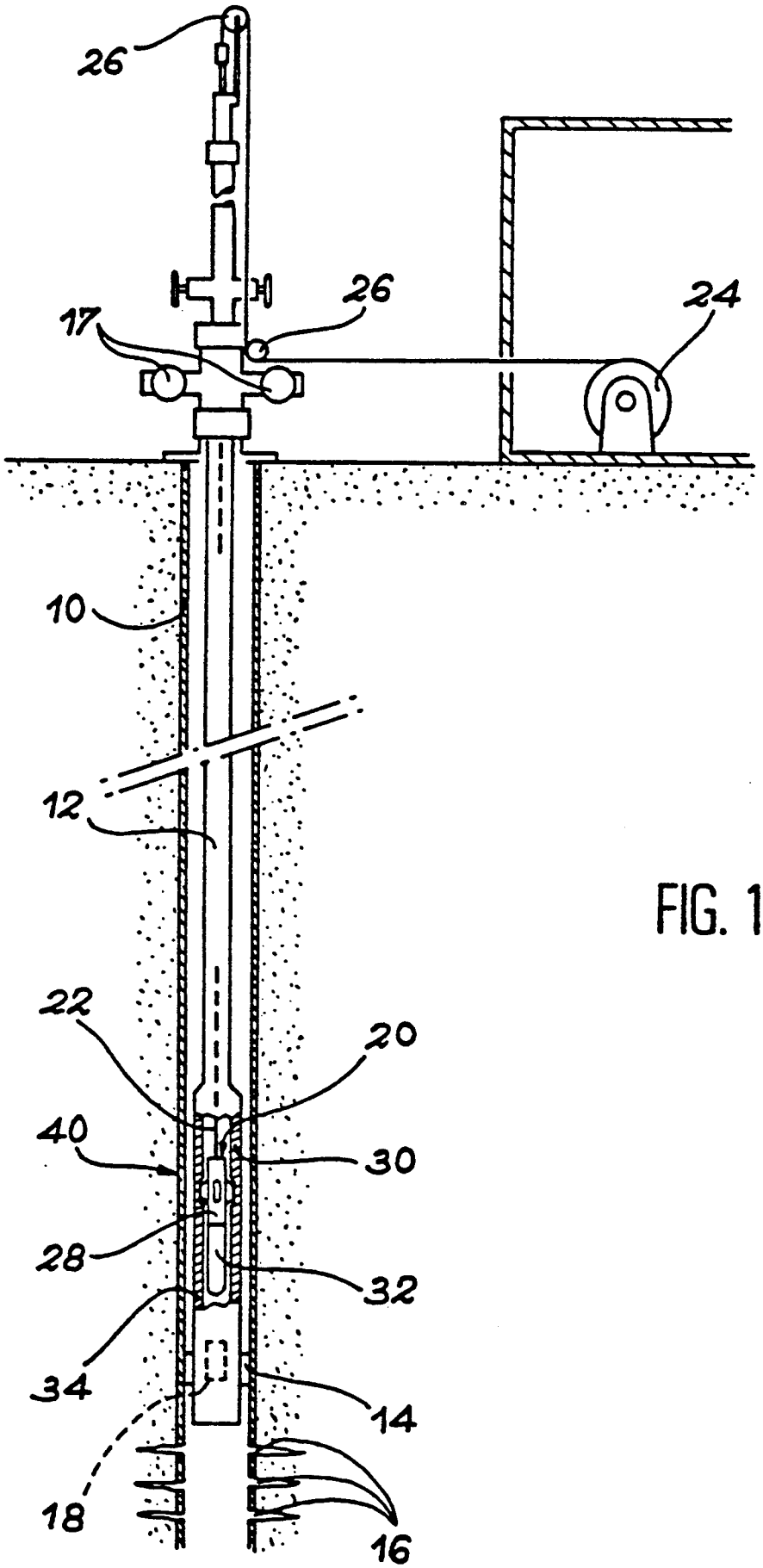
FIG. 1 is a diagrammatic vertical section view through an example of the latching and unlatching device of the invention being used in an oil well.

FIG. 1 is a highly diagrammatic representation of an oil well including casing 10 that contains production tubing 12. An annular sealing device 14 (packer) is disposed between the bottom end of the tubing 12 and the casing 10. Perforations 16 through the casing 10 beneath the annular sealing device 14 communicate the well with a natural hydrocarbon reservoir. When the well is in production, the hydrocarbon fluid flows through the tubing 12 to the surface where it is collected via pipes under the control of valves 17.

In the bottom portion of the tubing 12, devices shown diagrammatically at 18 are permanently mounted for measuring and recording the temperature and the pressure prevailing at the bottom of the well. The temperature and pressure data recorded by such devices 18 are collected by lowering an assembly 20 down the well suspended from an electrically conductive cable 22, hereinafter referred to as the wireline assembly. The cable 22 runs along the tubing 12 and it emerges from the top thereof through a sealing device and then passes over sheaves 26 to be wound onto the drum 24 of a winch situated on the surface.

As shown in FIG. 1, the wireline assembly 20 comprises an upper latching portion 28 suitable for latching assembly 20 in a complementary portion 30 situated near the bottom of the tubing 12, a small distance above the devices 18. Beneath the latching portion 28, the wireline assembly 20 includes an electronics portion 32 suitable for being inductively coupled to the portion 34 of the tubing containing the devices 18. This inductive coupling enables the temperature and pressure data recorded in the devices 18 to be transmitted to the surface via the cable 22.

The inductive coupling between the portions 32 and 34 is achieved via two coils (not shown) which must be placed accurately at the same level to ensure that data is transmitted under the best possible conditions. This result is obtained by means of a latching and unlatching device given an overall reference 40 in FIG. 1, whereby the upper portion 28 of the wireline assembly 20 can be locked in the portion 30 of the tubing 12. The latching and unlatching device is described below with reference to FIGS. 2 to 5.

Figure 2:
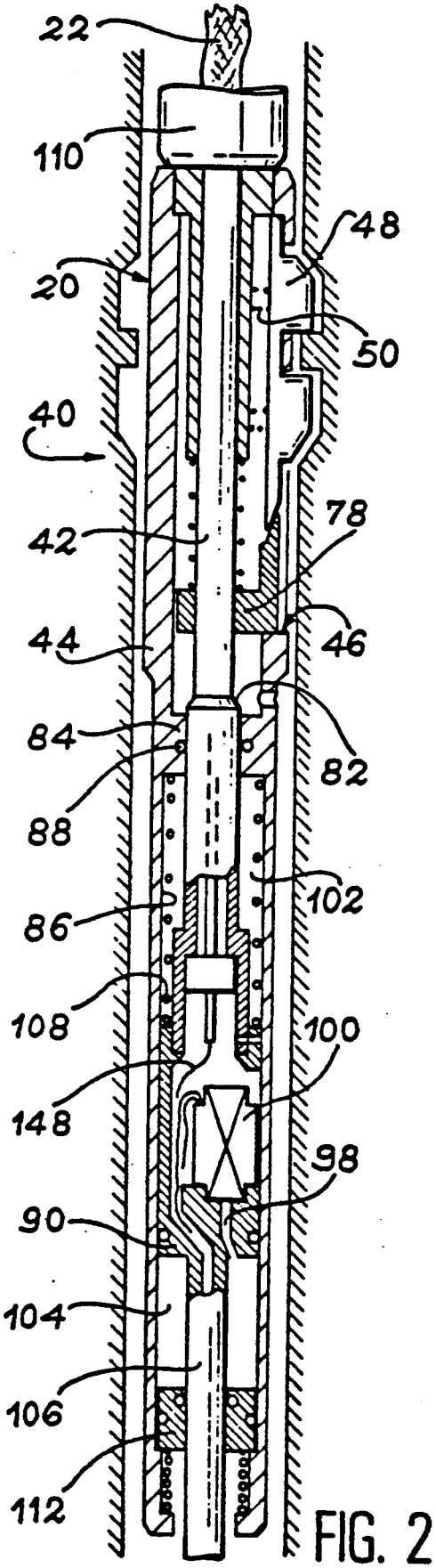
FIG. 2 is a vertical section view showing the latching and unlatching device of FIG. 1 on a larger scale and in its locked state.
Figure 5:
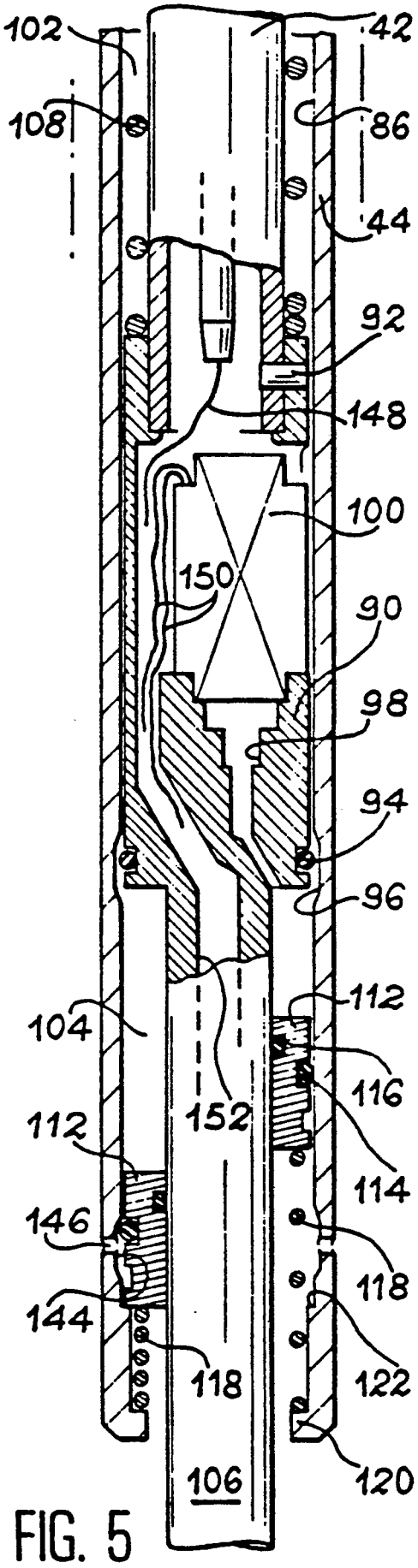
FIG. 5 is a longitudinal section view comparable to FIG. 4 showing the bottom portion of the device in particular including the control piston.

As shown initially in FIGS. 2 and 5, the latching portion 28 includes a circular section central rod 42 which is fixed to the bottom end of the cable 22. The rod 42 is mounted coaxially inside a tubular housing 44 in such a manner that these two members are capable of limited relative axial displacement.

The top portion of the tubular housing 44 includes a plurality of windows 46 which are disposed at the same level and regularly distributed around its periphery. There may be three such windows 46, and each of them receives a locking member 48, generally referred to as a key or a dog.

Figure 4:
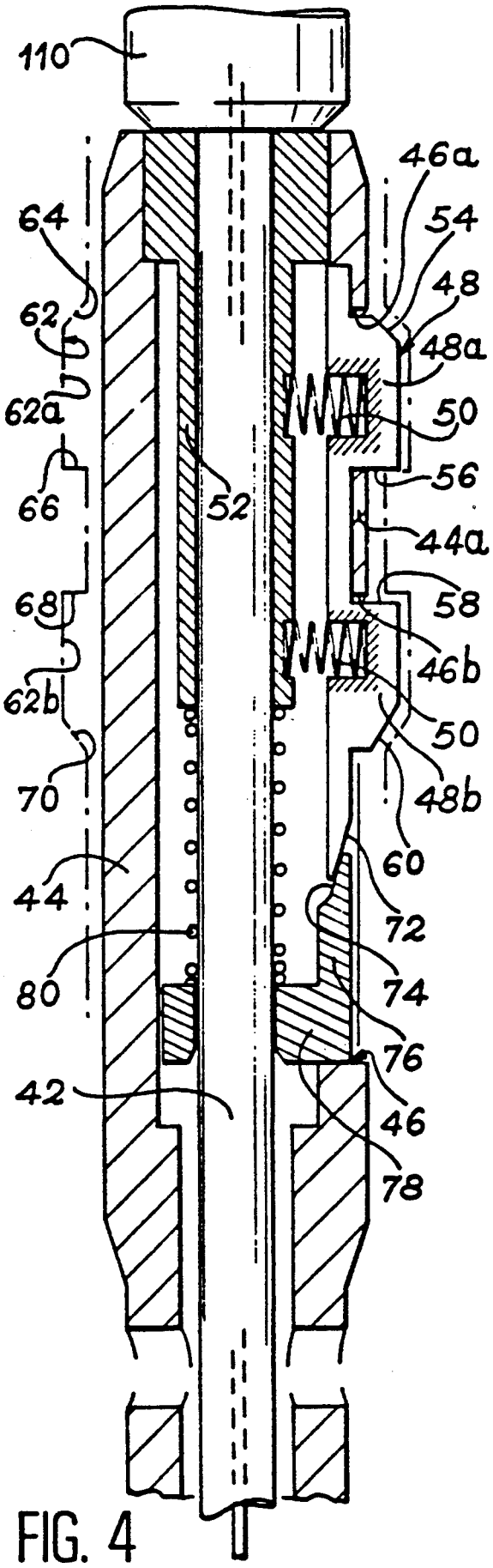
FIG. 4 is a vertical section view on a still larger scale showing the structure of the keys and the complementary recesses of the device shown in FIGS. 2 and 3.

As shown more clearly in FIG. 4, each of the keys 48 is supported by the tubular housing 44 so as to be radially movable relative to the longitudinal axis of the device. Two helical compression springs 50 that are spaced apart along the longitudinal axis of the device are interposed between each of the keys 48 and a tubular bottom portion 52 of the housing 44 so as to maintain the keys 48 normally in a projecting position as shown in FIGS. 2 and 4. In this position, a top portion **48*a* and a bottom portion 48*b* (FIG. 4) of each key 48 project radially outwards beyond the outside surface of the housing 44**.

More precisely, the projecting top portion 48*a* of each of the keys 48 penetrates into a top portion 46*a* of the window 46, while the projecting bottom portion 48*b* penetrates into a bottom portion 46*b*. The two projecting portions 48*a* and 48*b* of the key 48 are separated by a set-back portion which bears against a zone 44*a* of the tubular housing 44 between the portions 46*a* and 46*b* of the corresponding window 46.

The projecting top portion 48*a* of each of the keys 48 has a sloping top edge 54 constituting a ramp and a rectilinear bottom edge 56 extending perpendicularly to the longitudinal axis of the device. Similarly, the projecting bottom portion 48*b* of each of the keys 48 includes a rectilinear top edge 58 extending perpendicularly to the longitudinal axis of the device, and a sloping bottom edge 60 forming a ramp.

As shown in dot-dashed lines in FIG. 4, each of the keys 48 is designed to be received in a complementary recess 62 formed in the top of portion 30 provided in tubing 12. The recess 62 is annular in shape and its longitudinal section is complementary to the shape in longitudinal section of each of the keys 48. Thus, the recess 62 has a top portion 62*a* and a bottom portion 62*b*, respectively suitable for receiving the top portion 48*a* and the bottom portion 48*b* of each of the keys 48. The top portion 62*a* of the recess 62 includes a sloping top edge 64 that forms a ramp suitable for engagement with the edges 54, and a rectilinear bottom edge 66 perpendicular to the longitudinal axis of the device and suitable for engagement with the rectilinear edges 56. Similarly, the bottom portion 62*b* of the recess 62 includes a rectilinear top edge 68 perpendicular to the longitudinal axis of the device and suitable for engagement with the rectilinear edges 58, and a sloping bottom edge 70 forming a ramp and suitable for engagement with the sloping edges 60.

When the keys 48 are level with the recess 62, they penetrate therein under the action of the springs 50 such that the wireline assembly 20 is locked in the bottom portion of the tubing 12 positively and automatically by engagement of the rectilinear edges 56 and 58 with the rectilinear edges 66 and 68, respectively. The keys 48 thus engage the recesses 62 to form locking means whereby the wireline assembly 20 can be latched automatically to the downhole assembly 30, 34.

As also shown in FIG. 4, each of the keys 48 extends downwards beyond its projecting bottom portion 48*b* and includes a ramp 72 on its outside surface.

An unlocking collar 78 is slidably received on the central rod 42 immediately below the keys 48. A compression spring 80 is also mounted on the rod 42, between the bottom end of the tubular portion 52 and the unlocking collar 78, thereby normally maintaining said unlocking collar pressed against the bottom edge of each of the windows 46. In the bottom portion of each of the windows 46, the unlocking collar 78 is extended upwards by a finger 76 having an inside ramp 74 formed thereon complementary to the ramp 72 formed on the corresponding key, and normally in contact therewith. As shown clearly below, the unlocking collar 78 controls the release of the locking means formed by the keys 48 and the recess 62.

With reference again to FIG. 2, it can be seen that the central rod 42 includes an upwardly-directed shoulder 82 at a predetermined distance from the bottom face of the unlocking collar 78 and suitable for bearing therea against when the rod 42 moves upwards inside the tubular housing 44.

Beneath this shoulder 82, the central rod 42 passes in sealed manner through a horizontal partition 84 of the tubular housing 44 and penetrates into a cylinder 86 formed inside the tubular housing 44 coaxially about the longitudinal axis of the device. Sealing between the rod 42 and the partition 84 is provided by a sealing ring 88 which is received in a groove formed in the bore provided through the partition 84 to pass the central rod 42.

As shown more clearly in FIG. 5, the portion of the central rod 42 which penetrates into the cylinder 86 includes a control piston 90 at its bottom end suitable for sliding in sealed manner inside the cylinder 86. The connection between the rod 42 and the piston 90 is provided by shear pins 92 suitable for breaking when they are subjected to a shear force exceeding a predetermined value. The shear force may be obtained by applying a predetermined traction force to the able 22 from which the wireline assembly 20 is suspended.

Sealing between the control piston 90 and the cylinder 86 is provided by a sealing ring 94 received in a groove formed on the outside surface of the piston 90. As shown more clearly in FIG. 5, when the control piston 90 is in its normal or rest position in which the keys 48 are locked in the recess 62 when they are level therewith, the sealing ring 94 is level with a groove 96 machined in the inside surface of the cylinder 86.

The control piston 90 has a passage 98 passing therethrough and controlled by an electrically controlled valve 100 which is normally closed when not excited. By opening the valve 100, it is possible to communicate via passage 98 a top chamber 102 and a bottom chamber 104 defined by piston 90 inside cylinder 86. These two chambers 102 and 104 are filled with a hydraulic fluid such as oil. The piston 90, the passage 98 passing therethrough, and the valve 100 controlling said passage constitute unlatching authorization means. In their normal state (rest or locking), corresponding to the valve 100 being closed, unlatching is impeded.

As shown in FIGS. 2 and 5, the piston 90 extends downwards beyond the bottom end of the tubular housing 44 in the form of a link rod 106 of circular section lying on the longitudinal axis of the device. The bottom end of this link rod 106 supports the electronics portion 32 (FIG. 1) of the wireline assembly 20.

As shown more clearly in FIG. 2, a helical compression spring 108 is mounted in the top chamber 102 and its opposite ends bear respectively against the piston 90 and against the horizontal partition 84. The spring 108 thus normally maintains the control piston 90 in a low or rest position as shown in FIGS. 2 and 5, as determined by a part 110 (FIGS. 2 and 4) that provide mechanical and electrical interconnection of the cable 22 and the central rod 42 coming into abutment against the top end of the tubular housing 44.

As shown more clearly in FIG. 5, a pressure-balancing annular piston 112 is mounted between the cylinder 86 and the link rod 106, beneath the control piston 90, and defines the bottom of the bottom chamber 104. This piston 112 is in sealing engagement with the inside surface of the cylinder 86 via a sealing ring 114 received in a groove formed on the outside surface of the piston 112. The piston 112 also engages the outside surface of the link rod 106 via a sealing ring 116 received in a groove formed on the inside surface of piston 112.

A helical compression spring 118 is interposed between the bottom surface of the annular piston 112 and a shoulder 120 formed at the open bottom end of the tubular housing 44 so as to maintain the annular piston 112 normally apart from a shoulder 122 formed inside the housing 44, as shown on the righthand side of FIG. 5.

On the lefthand side of FIG. 5 it can be seen that the shoulder 122 limits the downwards displacement of the annular piston 112 against the action of the spring 118. When the piston 112 bears against said shoulder 122, the sealing ring 144 is level with a groove 124 formed inside the housing 44 and having holes 146 machined through the bottom thereof for communicating the groove with the outside.

Figure 3:
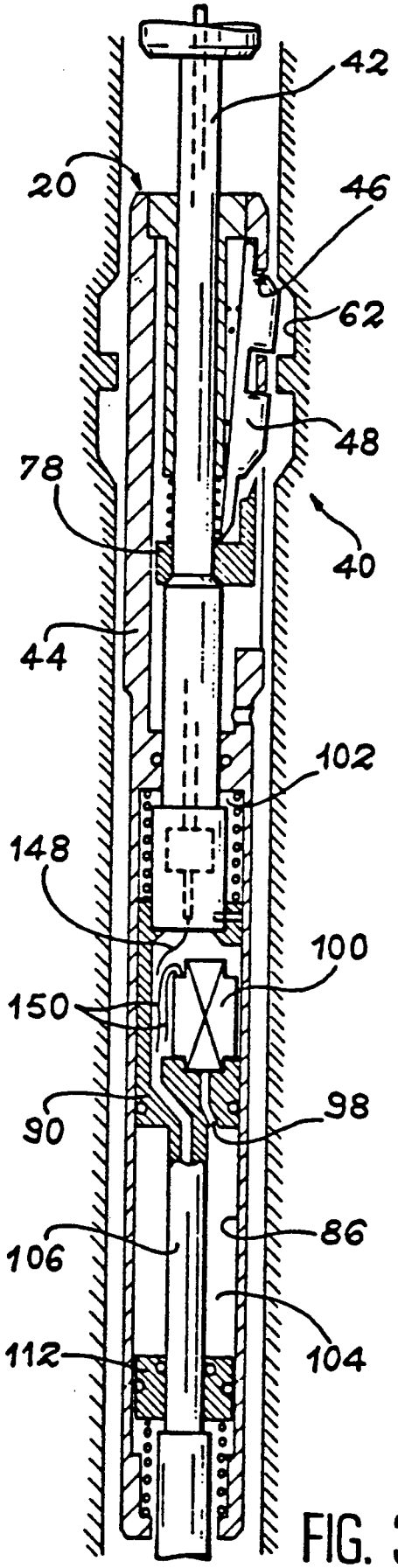
FIG. 3 is a section view comparable to FIG. 2 showing the latching and unlatching device in its unlocked state.

As shown in particular in FIGS. 3 and 5, electrical signals are transmitted between the cable 22 and the electronics portion 32 carried by the link rod 106 via an electrical conductor 148 which passes successively through the central rod 42, the piston 90, and the link rod 106. For the excitation of valve 100, an electrical source, acting via two electrical conductors 150, is included in the electronics portion 32. The conductors 148 and 150 pass through the control piston 90 and along the link rod 106 via a passage 152 provided for this purpose. It should be observed that the passage 152 communicates with the top chamber 102 and is used for filling the cylinder 86 with hydraulic fluid.

The operation of the device described above with reference to FIGS. 2 and 5 is described below.

When the wireline assembly 20 is lowered at the end of the cable 22, the various parts of the latching device occupy the positions shown in FIGS. 2 and 4 and on the righthand side of FIG. 5. In particular, the control piston 90 occupies its rest position in which the sealing ring 94 is level with the annular groove 96. The inside diameter of the tubing 12 is generally slightly greater than the outside diameter of the top portion of the tubular housing 44 that carries the keys 48. Consequently, the keys should theoretically be most completely retracted inside the housing 44.

As soon as the keys 48 come level with the recess 62 formed in the portion 30 mounted at the bottom of the tubing 12, the springs 50 cause the keys 48 to penetrate into the recess, thereby instantaneously effecting the positive locking of the wireline assembly 20 in said portion 30. Specifically, locking is effected by engagement of the surfaces 56 and 58 with the surfaces 66 and 68, respectively, without it being necessary to insert a locking member between the keys 48 preventing their retracting.

When it is desired to unlock the wireline assembly 20 from the portion 30, an operator sends an instruction for this purpose from the surface. The instruction is transmitted to the electronics portion 32 of the wireline assembly via the cable 22 and the electrical conductor 148. Upon reception by the electronics portion 32, the instruction causes the electrically-actuated valve 100 to be excited, whereby the chambers 102 and 104 are communicated via the passage 98.

By exerting a relatively limited tension force on the cable 22, it is then possible to displace the assembly constituted by the central rod 42, the piston 90, the link rod 106, and the electronics assembly 32 suspended from said rod upwards relative to the tubular housing 44 which remains locked inside the portion 30. Under the effect of such displacement, the shoulder 82 formed on the rod 42 moves progressively towards the unlocking collar 78 and then comes into abutment thereagainst, and causes it to move in turn. As shown in FIG. 3, upwards displacement of the unlocking collar 78 causes the ramps 72 and 74 (FIG. 4) to co-operate, thereby tilting the bottom portions of the keys 48 into the tubular housing 44. The tilt is such as to completely disengage the surfaces 56 and 58 from the surfaces 66 and 68 (FIG. 4). The latching device thus takes up the unlocked position and the wireline assembly 20 can be raised to the surface by means of the cable 22.

In addition to its simplicity, the latching device described above presents numerous advantages.

One of these advantages is that it is possible for the user to know at all times which state the device is in since the device normally occupies its locked position unless an unlatching instruction has been sent from the surface.

Further, the locked position which corresponds to the piston 90 being in its low position is obtained by means of the spring 108 such that the only movements of the cable 22 effective for the control of the device are pulls, which can always be exerted regardless of the deviation of the portion of the well in which the wireline assembly is to be found.

In addition, owing to the positive locking of the keys 48 in the recess 62 by means of the surfaces 56, 58, 66, and 68, there is no need for an internal locking member which would otherwise make it impossible to unlock the system from the surface.

This also has the consequence that it is impossible for the keys 48 to lock in a larger section portion of the tubing 12 that does not have the special shape of the recess 62. The ramp-shaped sloping surfaces 54 and 60 formed at both ends of the keys 48 ensure that it is always possible to disengage the wireline assembly when a tension is exerted on the cable.

Furthermore, should a failure make it impossible to operate the electrically controlled valve 100 while the wireline assembly is locked by means of the keys 48 engaging in the portion 30, it is still possible for an operator to retrieve the wireline assembly by pulling on the cable 22 with a force sufficient to break the shear pins 92. This causes retraction of the keys 48 by a mechanical action of the central rod 42 on the unlocking collar 78, so that unlatching can be achieved and the entire wireline assembly can be retrieved.

In the latching device of the invention, it should be observed that the pressures inside the top chamber 102 and the bottom chamber 104 are normally in equilibrium via the passage provided between the sealing ring 94 and the groove 96 while the piston 90 is in its rest position. Furthermore, this pressure is in equilibrium relative to the pressure inside the well because the annular piston 112 moves upwards or downwards depending on whether the external pressure increases or decreases.

Further, if an abnormal increase in temperature should cause the hydraulic fluid contained in the cylinder 86 to expand in a manner that is not compensated by a corresponding increase in the pressure outside the device, the annular piston 112 comes into abutment in the position shown in the lefthand half of FIG. 5, thereby enabling a portion of the hydraulic fluid to escape to the outside via the groove 144 and the passage 146.

It should be observed that if a tension is exerted on the cable 22 while the valve 100 is closed, the resulting rise of the piston 90 inside the cylinder 86 immediately brings the sealing ring 94 into sealing contact with the surface of the cylinder, thereby having the effect of closing the passage between the chambers 102 and 104 and of preventing continued upwards motion of the control piston 90. The same occurs if a shock is applied to the bottom end of the electronics portion 32. Further, co-operation between the piston 90 and the hydraulic fluid contained in the cylinder 86 then has the effect of damping any such shock, with the assembly constituted by the cylinder 86 and the piston 90 behaving as a hydraulic shock absorber.

Finally, it should be observed that the large stroke which is provided between the shoulder 82 formed on the central rod 42 and the bottom face of the unlocking collar 78 gives an operator on the surface a certain amount of time to release the tension exerted on the cable 22, should it appear that the control piston is moving while the valve 100 is not actuated. Such movement indicates that there is an abnormal leak communicating the chambers 102 and 104, which leak may entail an undesirable unlatching of the latching device. Suitable means placed in the electronics portion 32 rapidly detect the movement of the piston inside the cylinder and immediately transmit this information to the surface via the electrical conductor 148 and the cable 22, thereby enabling the operator momentarily to release the tension exerted on the cable 22 before unlatching occurs.

Naturally, the invention is not limited to the embodiments described above by way of example, but extends to any variants. Thus, it will be understood that the movement of the control piston 90 could be transmitted to the keys 48 by means other than those described. Similarly, the control of hydraulic fluid transfer between the chambers 102 and 104 which is provided in the embodiment described by the valve 100 placed on the passage 98 could be performed by different means, such as a hydraulic pump control led by a motor or a non-return valve system controlled by the application of traction forces on the cable.

We claim:

1. A device for unlatching a wireline assembly suspended from a cable end latched via outwardly resiliently urged locking means to a downhole assembly placed in a well, comprising:

control means engageable with said locking means for retracting the locking means operable by tension exerted on the cable; and unlatching authorization means normally occupying a state in which said control means are locked, said unlatching authorization means being responsive to an unlatching authorization signal transmitted via the cable from the surface to take up a state in which the control means are unlocked and tension exerted on the cable is effective to operate said control means to retract said locking means.

2. A Device for unlatching a wireline assembly suspended from a cable and latched via locking means to a downhole assembly placed in a well, comprising:

control means for causing the locking means to release, operable by tension exerted on the cable; and unlatching authorization means normally occupying a state in which said control means are locked, said unlatching authorization means being responsive to an unlatching authorization signal transmitted via the cable from the surface to take up a state in which the control means are unlocked, said unlatching authorization means comprising:

a cylinder formed in the wireline assembly parallel to a longitudinal axis of said assembly and filled with hydraulic fluid;

a control piston linked to the control means and via which the wireline assembly is suspended from the cable, said piston being slidable inside the cylinder between a low or rest position in which the control means does not act on the locking means, and a high or actuated position in which the control means release the locking means; and means for controlled transfer of the hydraulic fluid through the piston, normally preventing said transfer and responsive to said unlatching authorization signal to authorize such transfer.

3. A device according to claim 2, wherein said means for controlled transfer comprise at least one passage passing through the control piston and means for controlling said passage, which means are normally closed and are responsive to the unlatching authorization signal to open the passage.

4. A device according to claim 3, wherein said means for controlling the passage comprise an electrically-controlled valve.

5. A device according to claim 4 further including a pressure balancing piston having one face in contact with the hydraulic fluid contained in the cylinder and having its opposite face in contact with the fluid contained in the well.

6. A device according to claim 3 further including a pressure balancing piston having one face in contact with the hydraulic fluid contained in the cylinder and having its opposite face in contact with the fluid contained in the well.

7. A device according to claim 2, wherein the control piston carries a sealing ring adapted for sealingly engaging the cylinder, said cylinder including a pressure-balancing groove which the sealing ring normally faces when the control piston is in its low or rest position.

8. A device according to claim 2 further including a pressure balancing piston having one face in contact with the hydraulic fluid contained in the cylinder and having its opposite face in contact with the fluid contained in the well.

9. A method of operating a wireline assembly suspended from a cable relative to a downhole assembly placed in a well, wherein latching of a wireline assembly into the downhole assembly is performed automatically by co-operation between complementary abutment surfaces extending perpendicularly to a longitudinal axis common to said assemblies and formed respectively on outwardly resiliently urged retractable keys of the wireline assembly and in a complementary recess of the downhole assembly and unlatching comprises the steps of:

transmitting an unlatching authorization signal from the surface to the wireline assembly via the cable to unlock a control means disposed in said wireline assembly for retracting said keys; and exerting tension on the cable so as to actuate said control means to cause the keys to be retracted, thereby disengaging the complementary abutment surfaces.

10. A device for latching and unlatching a wireline assembly suspended from a cable relative to a downhole assembly placed in a well, the device comprising retractable keys mounted in the wireline assembly, first resilient means normally maintaining the keys in a projecting position, and a recess that is complementary to the keys and that is formed in the downhole assembly, wherein:

the keys and the recess include complementary abutment surfaces extending perpendicularly to the longitudinal axis of the device and further comprising:

control means for controlling retraction of the keys and operable by tension exerted on the cable; and unlatching authorization means, normally occupying a locking state for locking the control means and responsive to an unlatching authorization signal transmitted by the cable from the surface to switch the control means to an unlatching state, said unlatching means comprising:

a cylinder formed in the wireline assembly extending parallel to the longitudinal axis of said assembly and filled with hydraulic fluid;

a control piston linked to the control means and via which the wireline assembly is suspended from the cable, said piston being slidable inside the cylinder between a low or rest position in which the control means do not act on the keys, and a high or actuated position in which the control means retract the keys;

second resilient means normally urging the control piston to it low or rest position; and means, for controlled transfer of the hydraulic fluid through the piston, normally preventing said transfer and responsive to said unlatching authorization signal to authorize said transfer.

11. A device according to claim 10, wherein the means for controlled transfer comprise at least one passage passing through the control piston and means for controlling said passage, which means are normally closed and are responsive to the unlatching authorization signal to open the passage.

12. A device according to claim 11, wherein the means for controlling the passage comprise an electrically-controlled valve.

13. A device according to claim 10, wherein the control piston carries a sealing ring suitable for sealing engagement with the cylinder, which cylinder includes a pressure balancing groove that normally faces the annular sealing ring when the control piston is in its low or rest position.

14. A device according to claim 10 further including a pressure balancing piston having one face in contact with the hydraulic fluid contained in the cylinder and having its opposite face in contact with the fluid contained in the well.

15. A device according to claim 10, wherein the control system is fixed to the cable via a link rod slidable in a housing supporting the keys and in which the cylinder is formed.

16. A device according to claim 10, wherein the control means comprise an unlocking collar slidable in the housing along the longitudinal axis of the device, the unlocking collar being adapted for engagement with an abutment formed on said rod and with a ramp formed on each key so as to retract the keys against the force of the first resilient means when tension is exerted on the cable after the means for controlled transfer of the hydraulic fluid have received the unlatching authorization signal.

17. A device according to claim 16, wherein the control piston is fixed to the link rod by at least one shearable member.

18. A device according to claim 16, wherein, when the control piston is in its low or rest position, the abutment is separated from the unlocking collar by a predetermined operating clearance, such that displacement of the piston towards its high or actuated position causes the keys to be retracted against the force of the first resilient means after a delay.

19. A device according to claim 18 further including means for detecting displacement of the control system in the cylinder and for immediately transmitting a signal representative of said displacement to the surface, prior to the keys being retracted.

* * * * *